US006949713B2

(12) United States Patent
Weng et al.

(10) Patent No.: US 6,949,713 B2
(45) Date of Patent: Sep. 27, 2005

(54) LIGHTING SYSTEM HAVING VIBRATION SWITCH AND WITH PLURALITY OF DISPLAYING SEQUENCES

(76) Inventors: Ming-Bi Weng, 235 Chung - Ho Box 8-24, Taipei (TW); Pi-Lin Wang, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/967,785

(22) Filed: Oct. 19, 2004

(65) Prior Publication Data

US 2005/0161309 A1 Jul. 28, 2005

Related U.S. Application Data

(63) Continuation-in-part of application No. 10/762,140, filed on Jan. 22, 2004, now abandoned.

(51) Int. Cl.[7] ..... H01H 35/14; H01H 35/02
(52) U.S. Cl. ..... 200/61.45 R; 200/61.52
(58) Field of Search ..... 200/61.45 R–61.53

(56) References Cited

U.S. PATENT DOCUMENTS 3,502,831 A * 3/1970 McRoskey ..... 200/61.49
3,649,787 A * 3/1972 Kasabian ..... 200/61.45 R
4,746,774 A * 5/1988 Tetrault et al. ..... 200/61.45 R
4,942,386 A * 7/1990 Willis ..... 340/566
5,955,712 A * 9/1999 Zakutin ..... 200/61.48
6,198,059 B1 * 3/2001 Jou ..... 200/61.52
6,329,618 B1 * 12/2001 James et al. ..... 200/61.45 M
6,784,386 B2 * 8/2004 Chou et al. ..... 200/61.51

* cited by examiner

*Primary Examiner*—K. Richard Lee

(57) ABSTRACT

A lighting system having a vibration switch for a footwear is disclosed. The system comprise a vibrating switch turning "on" or "off" responsive to motions of the footwear. The vibrating switch further comprises an isolating housing, a spring on the isolating housing, one end of the spring being a free end and another end thereof being a fixing end, a conductive plate in the isolating housing; a metal support plate in the isolating housing and being at another side of the conductive plate; and a first and a second pins; the first pin being connected to the conductive plate and extending out of the isolating housing; and the second pin connected to the metal support plate and extending out of the isolating housing. When the isolating housing vibrates, the free end of the spring will swing to contact the conductive plate so as to conduct current to the conductive plate.

15 Claims, 5 Drawing Sheets

LIGHTING SYSTEM HAVING VIBRATION SWITCH AND WITH PLURALITY OF DISPLAYING SEQUENCES

The present invention is a continuation in part of U.S. patent application with Ser. No. 10/762,140 filed Jan. 22, 2004 now abandoned assigned to the inventor of the present invention, which also the applicant of the present invention. Thereby, the content of the U.S. patent application with Ser. No. 10/762,140 is incorporated into the present invention as a part of the present invention.

FIELD OF THE INVENTION

The present invention relates to vibrating switches and particular to a lighting system having a vibration switch and presenting a plurality of displaying sequences wherein a novel vibration switch is used with the light emitting shoes so that the shoes can present a beautiful outlook as the wearer walks. The vibrating switch has no steel ball and being installed obliquely. Thereby, the installation of the vibrating switch is easy.

BACKGROUND OF THE INVENTION

Light footwear is popular with men, women and children for reasons of safety by rendering the wearers more visible at night, and for reasons of fashion. Such footwear typically includes at least one light source and preferably a plurality of light sources such as light emitting diodes, a source of power such as a battery, and a switch to connect the battery to the light source to illuminate them.

There are known in the art several different implementation of footwear lighting systems that produce flashing lights, These implementations typically rely on the opening and closing of a switch to create the flashing effect. Many different types of switches have been used to create this effect. For example, pressure switches, mercury switches, and spring switches have all been used to generate flashing lights in footwear. However, in all of these systems, flashing only occurs in response to the connection or disconnection of the circuit created by the opening and closing of the switch. Furthermore, in systems which a plurality of lights, the lights, are illuminated in unison, with all the lights being illuminated at the same time.

Vibrating switches are widely used. In the prior art, mercury is used as a conductive media. Afterwards, rollers are used to replace mercury. Moreover, springs are used to replace rollers since the sensitivities of the springs are higher than those of rollers. There are two kinds of such structures. One has a metal housing and another has an isolating housing which is preferred than the metal housing since the insulating effect thereof.

The prior art vibrating switch has an isolating housing, a spring in the isolating housing, one end of the spring being a fixing end and another end thereof being a free end; a first conductive plate in the isolating housing and supporting the fixing end; a pin extended from the conductive plate and passing out of the isolating housing; a second conductive plate in the isolating housing and corresponding to the free end of the spring, another pin extending from the second conductive plate and passing out of the isolating housing; and a weight, like a small steel ball, attached to the free end of the spring.

The defects of aforementioned prior art are that the small steel ball can not be firmly secured to the free end of the spring. Thereby, in assembly, the steel ball is glued to the free end, but this is unbeneficial for electric conduction. Next, the free end of the spring is easily suspended downwards due to the weight of the small steel ball. Thereby, the spring is not horizontally arranged. Thereby, initially, the free end of the spring must be inclined, but this makes a difficult to workers.

However there is a demand for a novel vibration switch which can be used with the light emitting shoes so that the shoes can present a beautiful outlook as the wearer walks.

SUMMARY OF THE INVENTION

Accordingly, the primary object of the present invention is to provide a lighting system having a vibration switch and presenting a plurality of displaying sequences for a footwear. The system comprise a plurality of light emitting sources; a power source for providing power; a vibrating switch turning "on" or "off" responsive to motions of the footwear; a key trigger being triggered in response to the turning "on" of the switch in an actuating period and the key trigger being inactive in response to an inactive time period; and a light source display sequence driver for driving the light sources to flash; the light source display sequence driver including a plurality of normal sequences for flashing the light sources and a plurality of dummy sequences for flashing no light sources. The vibrating switch further comprises an isolating housing, a spring on the isolating housing, one end of the spring being a free end and another end thereof being a fixing end, a conductive plate in the isolating housing corresponding to the free end of the spring and having a gap to the free end; a metal support plate in the isolating housing and being at another side of the conductive plate for supporting the fixing end of the spring so that the spring is not supported in the lower end; and a first and a second pins; the first pin being connected to the conductive plate and extending out of the isolating housing; and the second pin connected to the metal support plate and extending out of the isolating housing. When the isolating housing vibrates, the free end of the spring will swing to contact the conductive plate so as to conduct current to the conductive plate.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
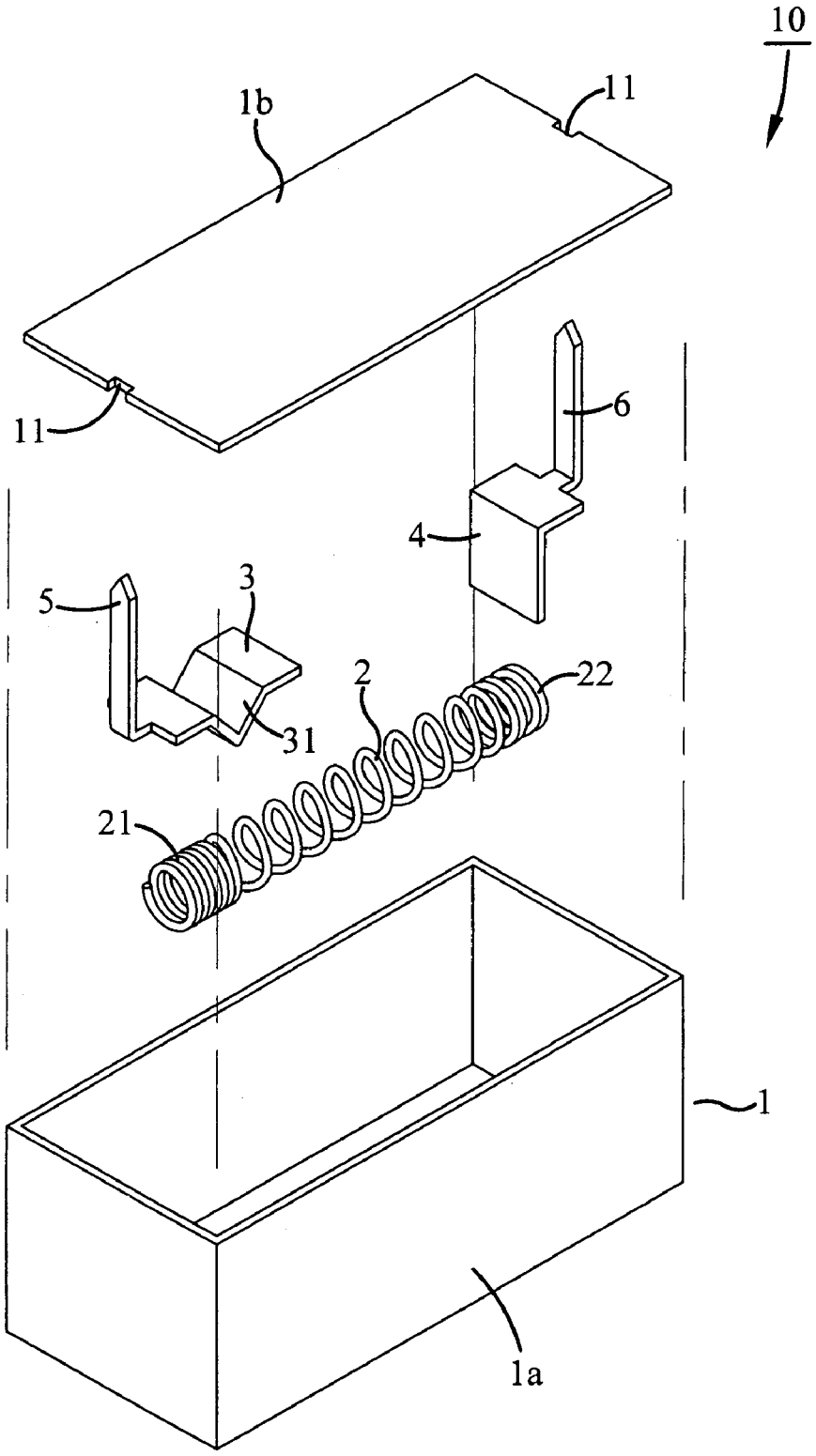
FIG. 1 is an exploded perspective view of the vibrating switch in the first embodiment of the present invention.

With reference to FIG. 1, the exploded perspective view of the present invention is illustrated. The vibrating switch 10 of the present invention includes an isolating housing 1, a spring 21 on the isolating housing 1, one end of the spring 21 being a free end 21 and another end thereof being a fixing end 22, a conductive plate 3 in the isolating housing 1 corresponding to the free end 21 of the spring 21 and having a gap to the free end 21; a metal support plate 4 in the isolating housing 1 and being at another side of the conductive plate 3 for supporting the fixing end 22 of the spring 21 so that the spring 21 is not supported in the lower end; and two pins 5, and 6; one pin 5 being connected to the conductive plate 3 and extending out of the isolating housing 1; and another pin 6 connected to the metal support plate 4 and extending out of the isolating housing 1. The pin 5 is integrally formed with the conductive plate 3 and the pin 6 is integrally formed with the metal support plate 4. The isolating housing 1 is formed with a casing 1*a* and a bottom plate 1*b*. The pins 5, 6 are protruded out of notches of the casing 1*a* to be fixed to a circuit board (not shown). The assembled view of the present invention is illustrated in FIG. 2.

Figure 2:
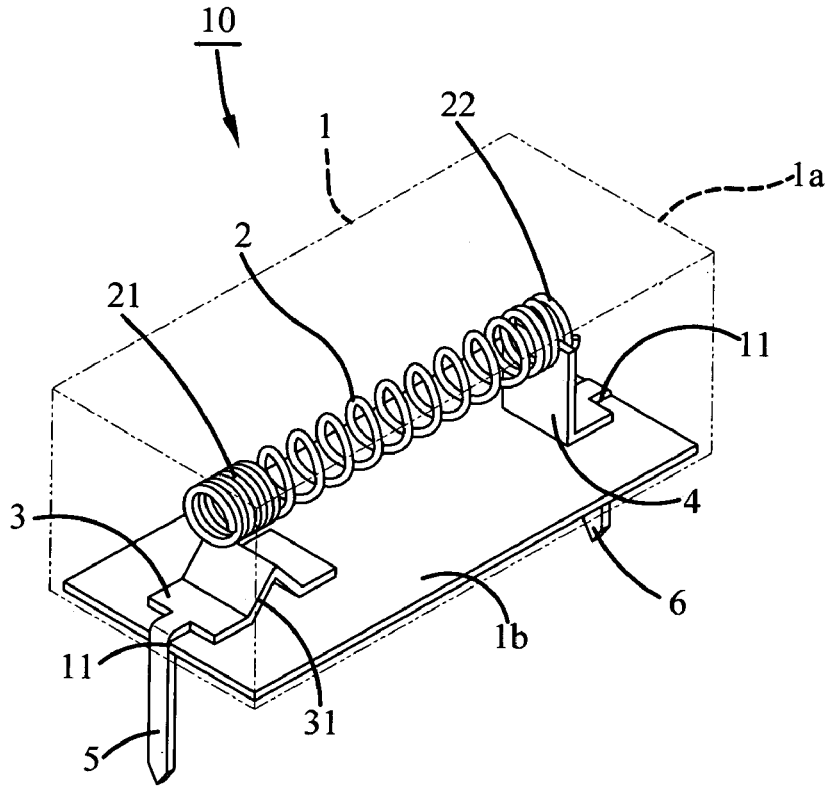
FIG. 2 is an assembled perspective view of the vibrating switch illustrated in FIG. 1.
Figure 3:
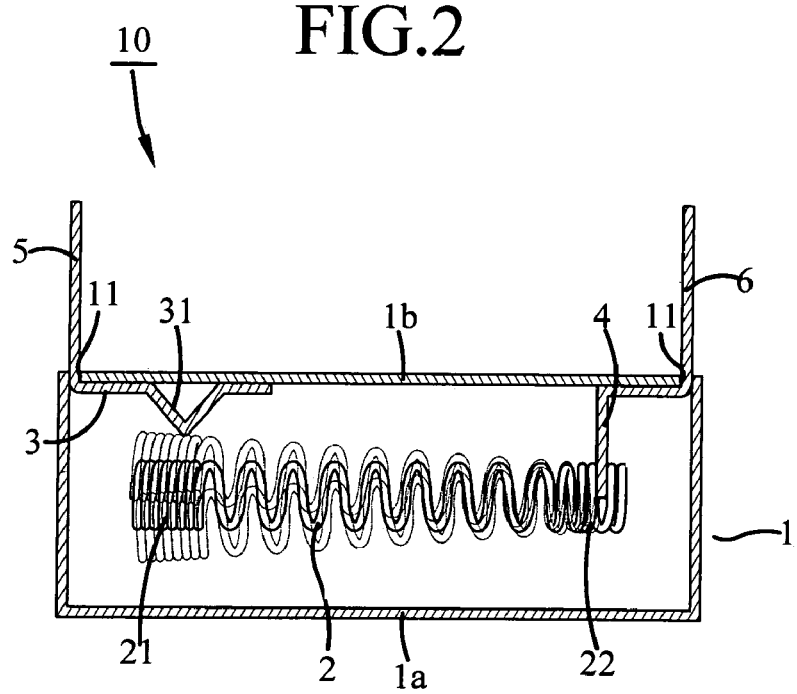
FIG. 3 is a cross section view about the vibrating switch of FIG. 1.

Referring to FIG. 2, the spring 21 is at a center position of the isolating housing 1. The free end 21 and fixing end 22 are at two ends and the springs are dense at the two ends. Thereby, the dense area at the free end 21 is longer than that of the fixing end 22. The fixing end 22 is welded to the metal support plate 4. Thereby, the spring 21 is supported from an upper side thereof. The free end 21 is swingable by the weight itself. As the isolating housing 1 vibrates, the free end 21 will have a larger vibrating extent, as shown in FIG. 3. In vibration, as the free end 21 contacts the conductive plate 3, electric power is conducted therebetween.

Furthermore, to have more contact times between the free end 21 and the conductive plate 3, a protruding wedge 31 can be added to the conductive plate 3 for reducing the gap between the wedge 31 and the free end 21 so as to have a larger contact possibility.

Figure 4:
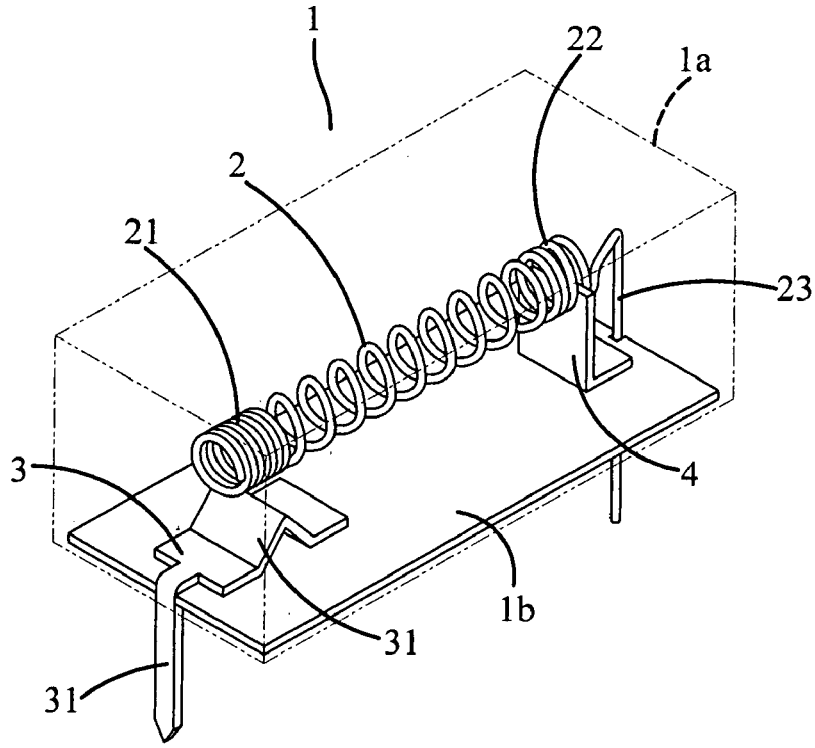
FIG. 4 is an assembled perspective view of the vibrating switch in the second embodiment of the present invention.
Figure 5:
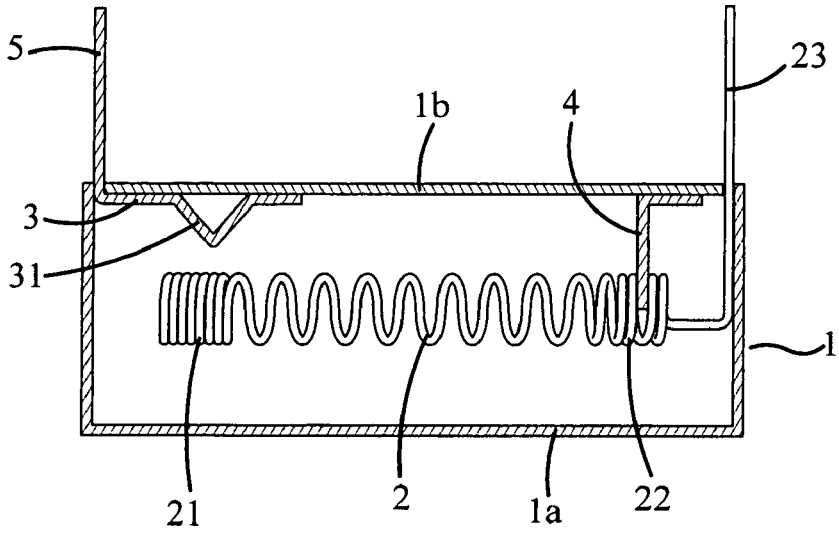
FIG. 5 is a cross section view of the vibrating switch in FIG. 4.

With reference to FIG. 4, another embodiment of embodiment is illustrated. The difference of this embodiment from above mentioned embodiment is that a pin 23 extending from the fixing end 22 of the spring 2 and passing out of the isolating housing 1 for replacing the pin 6. The spring 2 has the same wire with the pin 23. The vibration of this embodiment is illustrated in FIG. 5.

Figure 6:
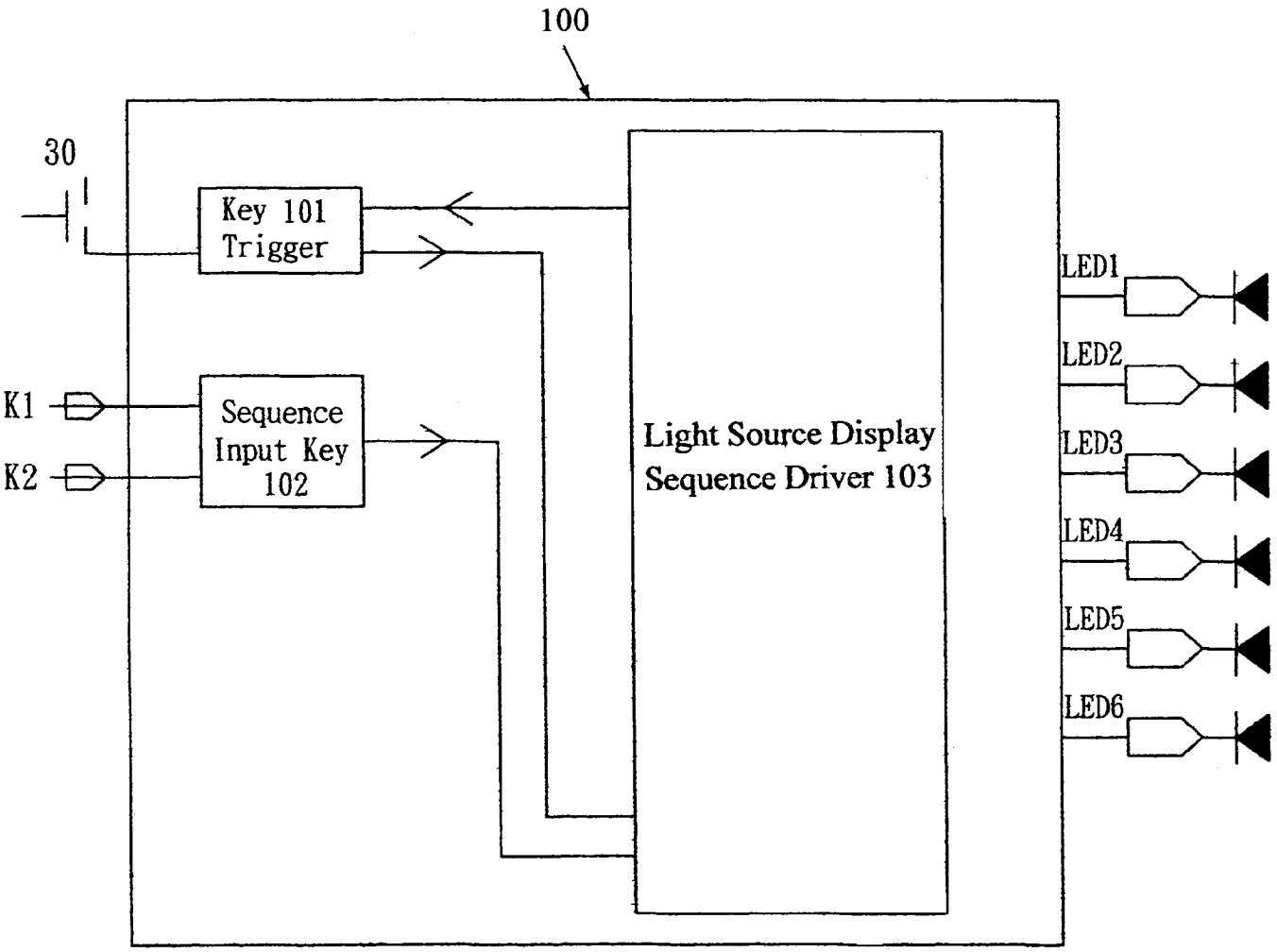
FIG. 6 shows a block diagram of the lighting system having a vibration switch and presenting a plurality of displaying sequences.

Referring to FIG. 6, it is illustrated that the vibration switch is used to a switching circuit of a light emitting shoe. In the present invention, a lighting system is incorporated in the sole of a footwear and includes at least one light source and preferably a plurality of light sources, e.g., LED 1, LED2, LED3, LED4, LED5, and LED6. Rather than light emitting diodes, incandescent, electro-luminescent, infrared, or ultraviolet light source can be used. All these are within the scope of the present invention. The light source can be arranged around the periphery of the heel of the sole, but they can be arranged anywhere on the shoe, including the upper side. The number of light sources used can not confined.

The light sources LED1 to LED 6 receive electrical current from a module 50, preferably embedded in the sole. The module contains a battery (not shown), for example, a 3 volt lithium battery having the shape of a circular disk. The battery is mounted on one side of the module 50.

The plurality of light emitting sources LED1 to LED 6 arrange on one side of the module 100.

A power source 70 serves for providing power to all the elements of the module 100. To make the circuit to have a pure outlook, the power circuits from the power source 70 to other elements are negative. In the drawing, only signal circuits are illustrated.

A switch 30 is on one side of the module 50, the switch 30 turned "on" or "off" responsive to the motion of the footwear. In the present invention, the switch 30 is the vibration switch (as the element 10 in FIG. 1 to FIG. 3) as illustrated in the drawings.

A key trigger 101 in the module 50 can be triggered in response to the turning "on" of the switch 30 in an actuating period. The actuating period is a period in which the key trigger can be actuated in response to the action of the switch 30. In the present invention, also an inactive time period is defined, which will be discussed in the following.

A sequence input key 102 has a plurality of inputs K1 and K2 for determining a display sequence of the light sources.

A light source display sequence driver 103 serves for driving the light sources in response to the actions of the key trigger 101 and the sequence input key 102. The light source display sequence driver 103 has a plurality of function blocks which execute the respective predetermined functions defined in the blocks.

Figure 7:
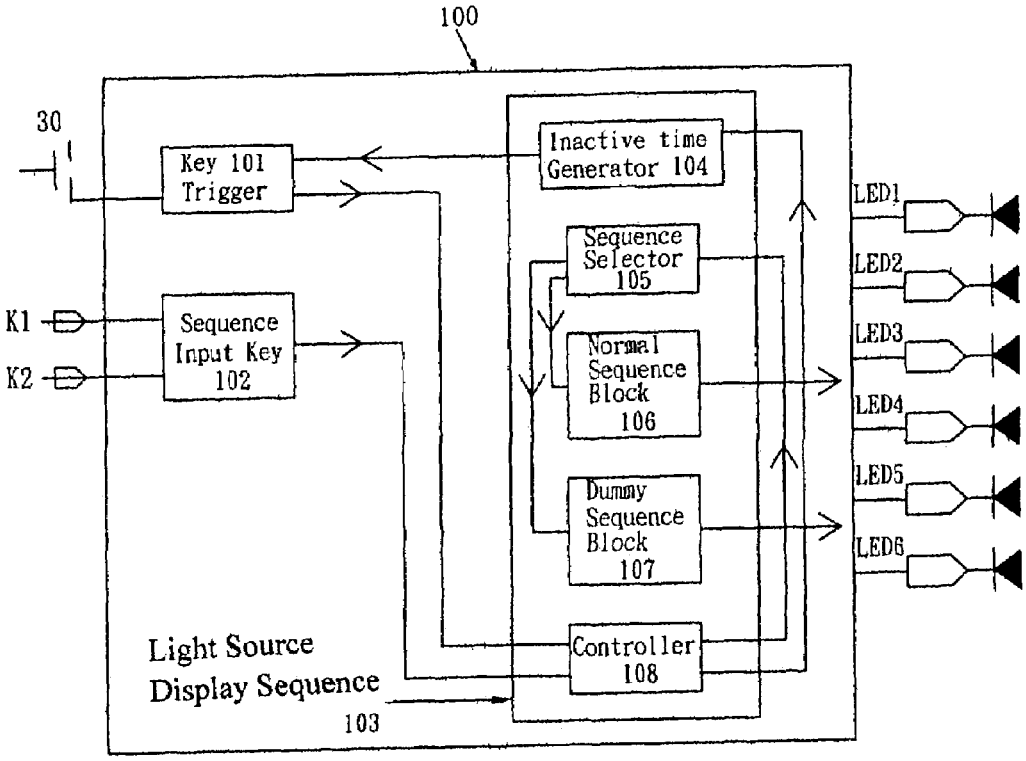
FIG. 7 shows another block diagram of the lighting system having a vibration switch and presenting a plurality of displaying sequences.

Referring to FIG. 7, the detail of the light source display sequence driver 103 is further illustrated, wherein all the detail elements are shown. The light source display sequence driver 103 comprises the following components.

An inactive time generator 104 in the light source display sequence driver 103 serves for generating an inactive time period to the key trigger 101. In this inactive time period, the key trigger will be inactive even the switch turns "on", that is, the turning "on" of the switch 30 will not actuate the key trigger 101 and thus the actions of the light sources are not affected by the switch 30.

A controller 108 receives the inputs from the key trigger 101 and a sequence input key 102. The controller 108 is actuated by the key trigger 101 so as to display the light sources in response to a selective sequence from the sequence input key 102.

A sequence selector 105 serves for actuating a sequence for displaying the light sources according to the indication from the controller 108. The sequence selector 105 also actuates the inactive time generator 104 for generating an inactive time period according to a selected sequence from the controller 108.

A normal sequence block 106 stores a plurality of sequences for actuating the light sources. The normal sequence block 106 actuates a selected sequence in response to an indication from the sequence selector 105.

A dummy sequence block 107 stores a plurality of dummy sequences, i.e., sequences which do not actuate any light sources. The dummy sequence block 107 actuates no light source. In the present invention, the dummy sequences serve to provide a delay time for displaying the light sources and different dummy sequences provides different delay time. Moreover, the dummy sequence can be used with the normal sequences so that the display of the light sources can present many different patterns to enjoy the users and viewers.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lighting system having a vibration switch and presenting a plurality of displaying sequences for a footwear comprising:

a plurality of light emitting sources;

a power source for providing power;

a vibrating switch turning "on" or "off" responsive to motions of the footwear;

a key trigger being triggered in response to the turning "on" of the switch in an actuating period and the key trigger being inactive in response to an inactive time period; and a light source display sequence driver for driving the light sources to flash;

wherein the vibrating switch further comprising:

an isolating housing, a spring on the isolating housing, one end of the spring being a free end and another end thereof being a fixing end, a conductive plate in the isolating housing corresponding to the free end of the spring and having a gap to the free end;

a metal support plate in the isolating housing and being at another side of the conductive plate for supporting the fixing end of the spring so that the spring is not supported in the lower end; and a first and a second pins; the first pin being connected to the conductive plate and extending out of the isolating housing; and the second pin connected to the metal support plate and extending out of the isolating housing;

wherein when the isolating housing vibrates, the free end of the spring will swing to contact the conductive plate so as to conduct current to the conductive plate.

2. The lighting system having a vibration switch and presenting a plurality of displaying sequences for a footwear as claimed in claim 1, wherein the isolating housing is formed by a casing and a bottom plate.

3. The lighting system having a vibration switch and presenting a plurality of displaying sequences for a footwear as claimed in claim 1, wherein the first and second pins are at the same inner sides of the isolating housing.

4. The lighting system having a vibration switch and presenting a plurality of displaying sequences for a footwear as claimed in claim 1, wherein the first and second pins are at the opposite inner sides of the isolating housing.

5. The lighting system having a vibration switch and presenting a plurality of displaying sequences for a footwear as claimed in claim 1, wherein coils at the free end are denser than other area of the spring.

6. The lighting system having a vibration switch and presenting a plurality of displaying sequences for a footwear as claimed in claim 1, wherein the first pin integrally formed with the conductive plate and the second pin is integrally formed with the metal support plate.

7. The lighting system having a vibration switch and presenting a plurality of displaying sequences for a footwear as claimed in claim 1, wherein the sequence driver further comprising:

an inactive time generator in the light source display sequence driver for generating an inactive time period to the key trigger; in the inactive time period, the key trigger will be inactive even the switch turns "on", that is, the turning "on" of the switch will not actuate the key trigger and thus the actions of the light sources are not affected by the vibrating switch;

a controller receiving the inputs from the key trigger and a sequence input key; the controller being actuated by the key trigger so as to display the light sources in response to a selective sequence from the sequence input key; and a sequence selector for actuating a sequence for displaying the light sources according to the indication from the controller; the sequence selector also actuating the inactive time generator for generating an inactive time period according to a selected sequence from the controller.

8. The lighting system having a vibration switch and presenting a plurality of displaying sequences for a footwear as claimed in claim 7; wherein the sequence driver further comprising a normal sequence block storing a plurality of sequences for actuating the light sources; the normal sequence block actuating a selected sequence in response to an indication from the sequence selector; and a dummy sequence block storing a plurality of dummy sequences, i.e., sequences which do not actuate any light sources; the dummy sequence block actuates no light source; the dummy sequences serve to provide a delay time for displaying the light sources and different dummy sequences provides different delay time; the dummy sequence can be used with the normal sequences so that the display of the light sources can present many different patterns to enjoy the users and viewers.

9. The lighting system having a vibration switch and presenting a plurality of displaying sequences as claimed in claim 7, wherein the isolating housing is formed by a casing and a bottom plate.

10. The lighting system having a vibration switch and presenting a plurality of displaying sequences as claimed in claim 7, wherein the first and second pins are at the same inner sides of the isolating housing.

11. The lighting system having a vibration switch and presenting a plurality of displaying sequences as claimed in claim 7, wherein the first and second pins are at the opposite inner sides of the isolating housing.

12. The lighting system having a vibration switch and presenting a plurality of displaying sequences as claimed in claim 7, wherein coils at the free end are denser than other area of the spring.

13. The lighting system having a vibration switch and presenting a plurality of displaying sequences for a footwear as claimed in claim 1, wherein the sequence driver further comprising:

an inactive time generator in the light source display sequence driver for generating an inactive time period to the key trigger; in the inactive time period, the key trigger will be inactive even the switch turns "on", that is, the turning "on" of the switch will not actuate the key trigger and thus the actions of the light sources are not affected by the vibrating switch;

a controller receiving the inputs from the key trigger and a sequence input key; the controller being actuated by the key trigger so as to display the light sources in response to a selective sequence from the sequence input key; and a sequence selector for actuating a sequence for displaying the light sources according to the indication from the controller; the sequence selector also actuating the inactive time generator for generating an inactive time period according to a selected sequence from the controller.

14. The lighting system having a vibration switch and presenting a plurality of displaying sequences for a footwear as claimed in claim 13;

wherein the sequence driver further comprising a normal sequence block storing a plurality of sequences for actuating the light sources; the normal sequence block actuating a selected sequence in response to an indication from the sequence selector; and a dummy sequence block storing a plurality of dummy sequences, i.e., sequences which do not actuate any light sources; the dummy sequence block actuates no light source; the dummy sequences serve to provide a delay time for displaying the light sources and different dummy sequences provides different delay time; the dummy sequence can be used with the normal sequences so that the display of the light sources can present many different patterns to enjoy the users and viewers.

15. A lighting system having a vibration switch and presenting a plurality of displaying sequences for a footwear comprising:

a plurality of light emitting sources;

a power source for providing power;

a vibrating switch turning "on" or "off" responsive to motions of the footwear;

a key trigger being triggered in response to the turning "on" of the switch in an actuating period and the key trigger being inactive in response to an inactive time period; and a light source display sequence driver for driving the light sources to flash;

wherein the vibrating switch further comprising:

an isolating housing, a spring on the isolating housing, one end of the spring being a free end and another end thereof being a fixing end, a pin extending from the fixing end and passing out of the isolating housing;

a conductive plate in the isolating housing corresponding to the free end of the spring and having a gap to the free end; a second pin extending from the conductive plate and passing out of the isolating housing;

a support plate in the isolating housing and being at another side of the conductive plate for supporting the fixing end of the spring so that the spring is not supported in the lower end; and wherein when the isolating housing vibrates, the free end of the spring will swing to contact the conductive plate so as to conduct current to the conductive plate.

* * * * *